US009032980B2

(12) United States Patent
Büsing et al.

(10) Patent No.: US 9,032,980 B2
(45) Date of Patent: May 19, 2015

(54) DISHWASHER COMPRISING AT LEAST ONE ROTATABLE SPRAY ARM

(75) Inventors: Johannes Büsing, Emersacker (DE); Christian Jakob, Höchstädt (DE); Hans-Peter Nannt, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 100 days.

(21) Appl. No.: 13/879,813

(22) PCT Filed: Oct. 24, 2011

(86) PCT No.: PCT/EP2011/068518

§ 371 (c)(1), (2), (4) Date: Apr. 17, 2013

(87) PCT Pub. No.: WO2012/059353

PCT Pub. Date: May 10, 2012

(65) Prior Publication Data

US 2013/0206188 A1 Aug. 15, 2013

(30) Foreign Application Priority Data

Nov. 5, 2010 (DE) ..... 10 2010 043 462

(51) Int. Cl.

| | |
|---|---|
| ***A47L 15/22*** | (2006.01) |
| ***A47L 15/23*** | (2006.01) |
| ***A47L 15/42*** | (2006.01) |

(52) U.S. Cl.

CPC ..... *A47L 15/22* (2013.01); *A47L 15/23* (2013.01); *A47L 15/4219* (2013.01)

(58) Field of Classification Search

CPC ..... A47L 15/15; A47L 15/22; A47L 15/23; A47L 15/4214; A47L 15/4217; A47L 15/4219; A47L 15/4221; A47L 15/4278; A47L 15/4281; A47L 15/4282; A47L 15/4289; A47L 15/428; B08B 11/00

USPC ..... 134/172

See application file for complete search history.

(56) References Cited

U.S. PATENT DOCUMENTS

| | | | | |
|---|---|---|---|---|
| 3,319,640 | A | 5/1967 | LaFlame | |
| 4,134,414 | A * | 1/1979 | Jarvis et al. | 134/144 |

(Continued)

FOREIGN PATENT DOCUMENTS

| | | |
|---|---|---|
| DE | 2064411 A1 | 7/1972 |
| DE | 3442779 A1 | 6/1986 |

(Continued)

OTHER PUBLICATIONS

International Search Report PCT/EP2011/068518 dated Apr. 13, 2012.

*Primary Examiner* — Michael Barr
*Assistant Examiner* — Rita Adhlakha
(74) *Attorney, Agent, or Firm* — James E. Howard; Andre Pallapies

(57) ABSTRACT

A dishwasher includes a dishwashing compartment and a rack provided in the dishwashing compartment for holding items to be cleaned. A rotatable spray arm is associated with the rack for applying water or wash liquor liquid upon the items. Water or wash liquor liquid is supplied to the spray arm via an upright supply tube having at least one region which flares in a direction of the spray arm and a peripheral terminal end facing the spray arm. The terminal end of the supply tube is configured to project into the cavity and thereby is extended into the spray arm.

24 Claims, 5 Drawing Sheets

(56) References Cited

U.S. PATENT DOCUMENTS

| | | | | |
|---|---|---|---|---|
| 5,427,129 | A * | 6/1995 | Young et al. | 134/176 |
| 5,727,581 | A | 3/1998 | Tekriwal et al. | |
| 2003/0005950 | A1 * | 1/2003 | Tobbe et al. | 134/180 |
| 2005/0144773 | A1 | 7/2005 | Mathieu et al. | |
| 2006/0278258 | A1 * | 12/2006 | Kara et al. | 134/56 D |
| 2007/0289615 | A1 * | 12/2007 | Shin | 134/56 D |
| 2009/0032066 | A1 * | 2/2009 | Heisele et al. | 134/25.2 |

FOREIGN PATENT DOCUMENTS

| | | | |
|---|---|---|---|
| EP | 2389851 | A1 | 11/2011 |
| GB | 2253341 | A | 9/1992 |

* cited by examiner

DISHWASHER COMPRISING AT LEAST ONE ROTATABLE SPRAY ARM

BACKGROUND OF THE INVENTION

The invention relates to a dishwasher, especially a domestic dishwasher, comprising a dishwashing compartment, which is provided with at least one rack, in which items to be cleaned can be held, to which water and/or so-called wash liquor can be applied by way of at least one rotatable spray arm associated with the respective rack, the spray arm being supplied by an upright Venturi tube that flares in the direction of the spray arm and has a terminal end facing the spray arm.

Dishwashers are known in which at least one rotatable spray arm is fed with fresh water and/or so-called wash liquor liquid by a tube opening out in the center of the spray arm, the tube flaring slowly from a narrower profile point toward the opening. Such a supply tube is frequently referred to as a Venturi tube, based on a Venturi nozzle, as it is in a number of places in the present application.

At the narrow point the dynamic pressure—and speed—of the supplied liquid is particularly high, before it slows toward the flare. However the exit speed of the liquid at the exit nozzles of the respective spray arm should also still be significant, in order to be able to reach and work on all the items to be washed that are held in the rack, even large items. An increase in the pressure at the exit nozzles tends to require extension of the Venturi tube. The space this takes up is then lost for the items to be washed, so it is desirable to keep the Venturi tube as short as possible.

BRIEF SUMMARY OF THE INVENTION

The invention addresses the problem of increasing the hydraulic efficiency of the spray arm.

The invention creates a dishwasher, in particular a domestic dishwasher, in which, because the supply tube with its terminal end facing the spray arm projects into a cavity enclosed by the spray arm, thereby extending into the spray arm, the external length of the supply tube and therefore the space required can remain the same while the active length of the supply tube can be increased, so that more pressure can be present at the exit nozzles with the same space requirement or the space requirement can be reduced while keeping the pressure the same.

If, according to an advantageous development of the invention, the cross section of the Venturi tube flares continuously to its terminal end, the Venturi effect can be utilized up to a subregion of the height of the cavity of the spray arm, in other words far beyond the wall thickness.

A section through a side wall of the supply tube here can expediently have a profile that runs in a straight line or with aligned curvature from the narrowest point to the terminal end, with the radius of curvature decreasing in proximity to the terminal end so that a funnel-type shape results there. The supply tube therefore forms a favorable Venturi tube. The terminal end can therefore also transition very advantageously in a rounded manner into an inner wall region of the spray arm, without steps or edges, thereby optimizing the flow into the spray arm.

The Venturi tube preferably enters the spray arm from below for a spray arm fed from below. In order to have a long length without a large external space requirement, its terminal end then projects beyond a bottom wall region of the spray arm in the center region by at least three millimeters, in some instances in particular even by at least ten millimeters, preferably between three and twenty millimeters.

The Venturi tube can preferably have round symmetry, with the terminal end in particular not having to form the entire edge of the Venturi tube but forming the segment projecting furthest into the spray arm, thereby only having to extend over at least a subregion of the periphery of the Venturi tube. As the entire periphery does not form the terminal end, backflow possibilities for wash water can be formed between regions of the terminal end, thereby ensuring total drainage and avoiding dead volume.

For such total drainage according to one advantageous development at least one lowest region, located below the plane of the terminal end, is favorably provided in the cavity of the spray arm for water or so-called wash liquor held in the cavity of the spray arm, from which the water or wash liquor can flow back to empty the spray arm.

According to one expedient embodiment, for the water or wash liquor to flow back, at least one bypass line passing downward from the lowest region can be provided so that the terminal end can still form an edge that runs all the way round and the backflow is located outside the terminal end.

Alternatively or additionally the terminal end can also be broken for the water or wash liquor backflow, so that over part of the periphery a high edge is formed as an extension of the Venturi tube and at least one lower region is formed over another part, which serves as a drain for water or wash liquor held in the cavity of the spray arm into the Venturi tube.

The terminal end can then advantageously form two opposing upper edges of the Venturi tube, which transition respectively into raised web regions that are higher than the lowest regions and extend in the longitudinal direction of the spray arm, allowing the water to be conveyed at high pressure to the exit nozzles.

According to a further advantageous development each of the web regions very favorably has a raised cross-sectional surface configuration that drops at both sides, so that water can run in its totality from there into lower drain channels on both sides of the web regions that open into the at least one lowest region.

From a manufacturing point of view a lower shell of the spray arm is advantageously configured as a single piece with the Venturi tube, in particular as a molded plastic part.

The configurations and developments of the invention described above and/or set out in the subclaims can be applied individually or in any combination with one another, except for example where there are clear dependencies or incompatible alternatives.

BRIEF DESCRIPTION OF THE DRAWINGS

The invention and its advantageous configurations and developments and their advantages are described in more detail below with reference to drawings, each showing schematic diagrams, in which.

DETAILED DESCRIPTION OF EXEMPLARY EMBODIMENTS OF THE PRESENT INVENTION

Figure 1:
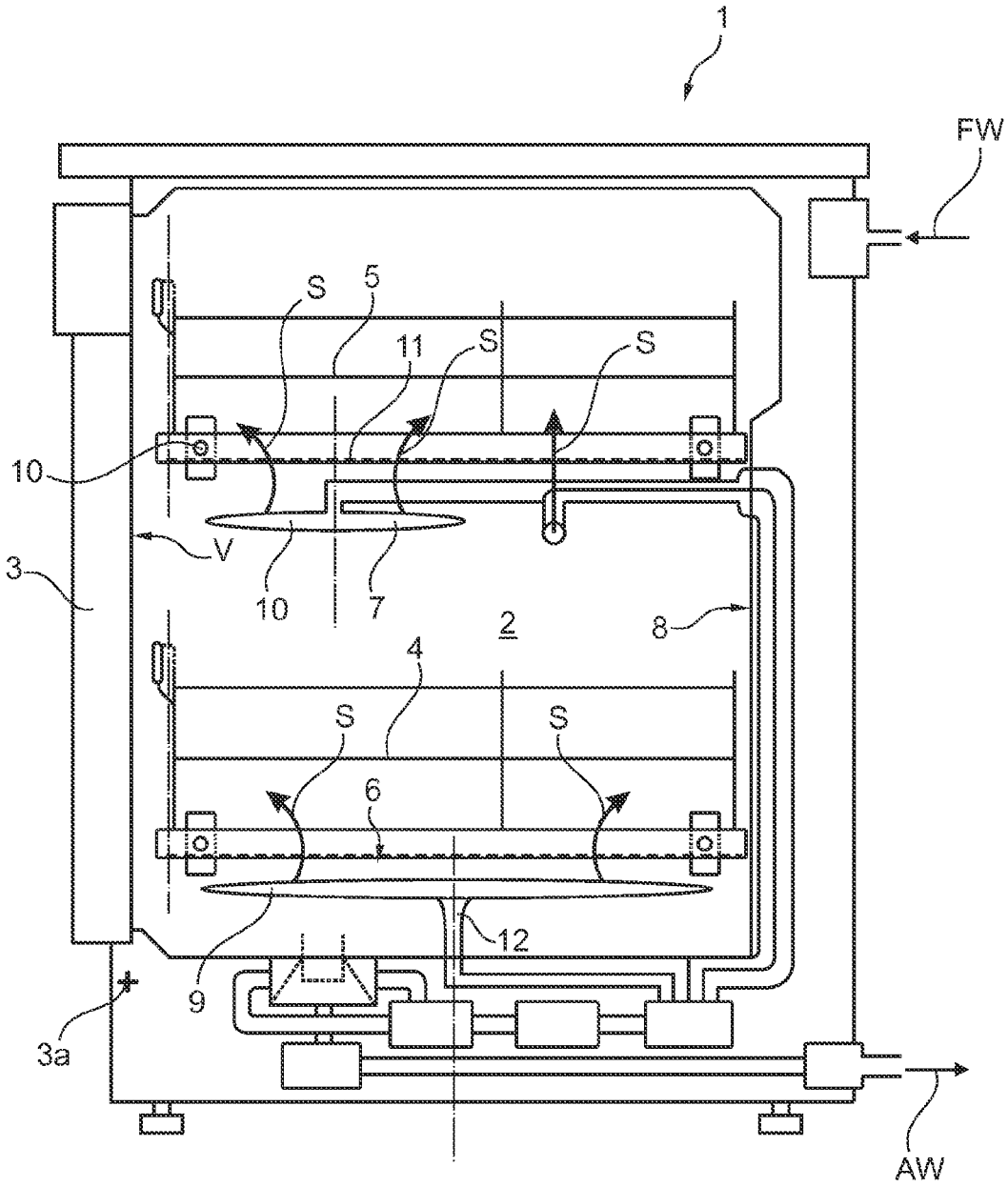
FIG. 1 shows a schematic side view of a dishwasher, with the side wall shown transparent for greater clarity, (110095)
Figure 2:
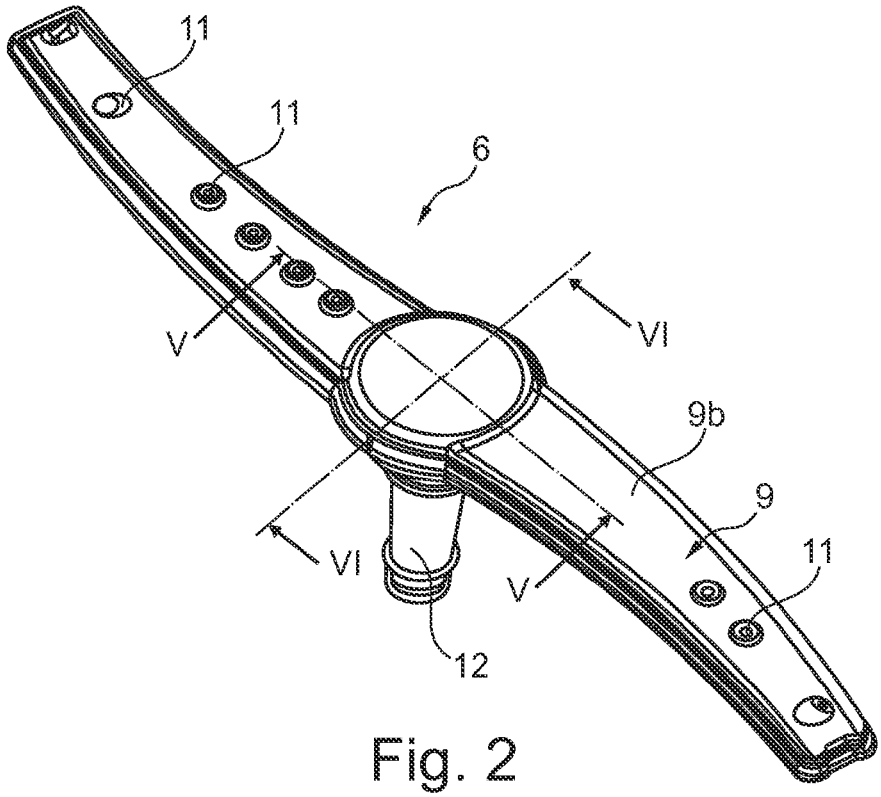
FIG. 2 shows a perspective detailed partial view from obliquely above of an exemplary rotatable spray arm with supplying Venturi tube.

In the figures below corresponding parts are shown with the same reference characters. Only those components of a dishwasher that are necessary for an understanding of the invention are shown with reference characters and explained. It goes without saying that the inventive dishwasher can comprise further parts and assemblies.

Elements of identical function and mode of operation are shown with identical reference characters in each of the figures.

The dishwasher 1 illustrated in FIG. 1 is a domestic dishwasher and has a dishwashing compartment 2 for holding items to be washed such as dishes, pots, flatware, glasses, cooking utensils and the like. The dishwashing compartment 2 can have an at least essentially rectangular base outline with a front face V facing a user in the operating position. The rectangle here can have either identical edge lengths or different edge lengths in the x and y directions, in particular so that the dishwashing compartment 2 is narrower in width than in its depthwise extension.

The compartment 2 can be closed off in particular on its front face V by a door 3—a cover on the top face can also serve as a door 3. FIG. 1 only shows part of the door 3, which can be pivoted for example about a lower horizontal axis 3*a*. The items to be washed can be held in at least one rack 4; in this instance just two racks 4, 5 are provided one above the other in the dishwashing compartment 2. The number of racks 4, 5 can vary depending on the dimensions and nature of the dishwasher 1. A so-called flatware rack can also be provided. Fresh water FW and/or circulating water containing detergent, rinse aid and/or other additional materials such as for example salts, dirt particles, descaling agents, etc, so-called wash liquor S, can be applied to said racks 4 by way of spray facilities 6, 7. The spray facilities 5, 6 here each comprise rotatable spray arms 9, 10, which apply an upward directed component to the items to be washed. A downward directed component can also be applied.

The racks 4, 5 can also be moved forward for example on rollers, in order to achieve an access position for the user, in which said user can easily load and empty the racks 4, 5. Lateral rails in the dishwashing compartment 2 are provided as tracks for the rollers. Handles can also be provided on the respectively front edges planes of the racks 4, 5 to facilitate the pushing in and pulling out of the racks 4, 5. When the door 3 is in the vertical closed position, the or each rack 4, 5 is in proximity to a rear wall 8 of the dishwashing compartment 2 located opposite the closed door 3 in an operating position.

FIGS. 2 to 7 show the lower spray facility 6 in detail and schematically. It comprises a rotatable spray arm 9, which during operation applies water FW and/or so-called wash liquor liquid S to the items being washed in the rack 4 through exit nozzles 11. This spray arm 9 can be supplied by an upright supply tube 12 at least one region of which flares in the direction of the spray arm 9. To this end it has a terminal end 13 facing the spray arm 9 and forming the highest region of the supply tube and can be rotated with the spray arm 9.

The supply tube 12 with its terminal end 13 facing the spray arm 9 projects here into a cavity 14 enclosed by the spray arm 9. This cavity 14 also serves as a water conducting chamber in the spray arm 9, which passes by way of it into the exit nozzles 11. By projecting into the cavity 14 the supply tube 12 extends into the spray arm 9 and therefore has an active length which is longer than the externally visible length of the supply tube 12 below the spray arm 9.

Figure 5:
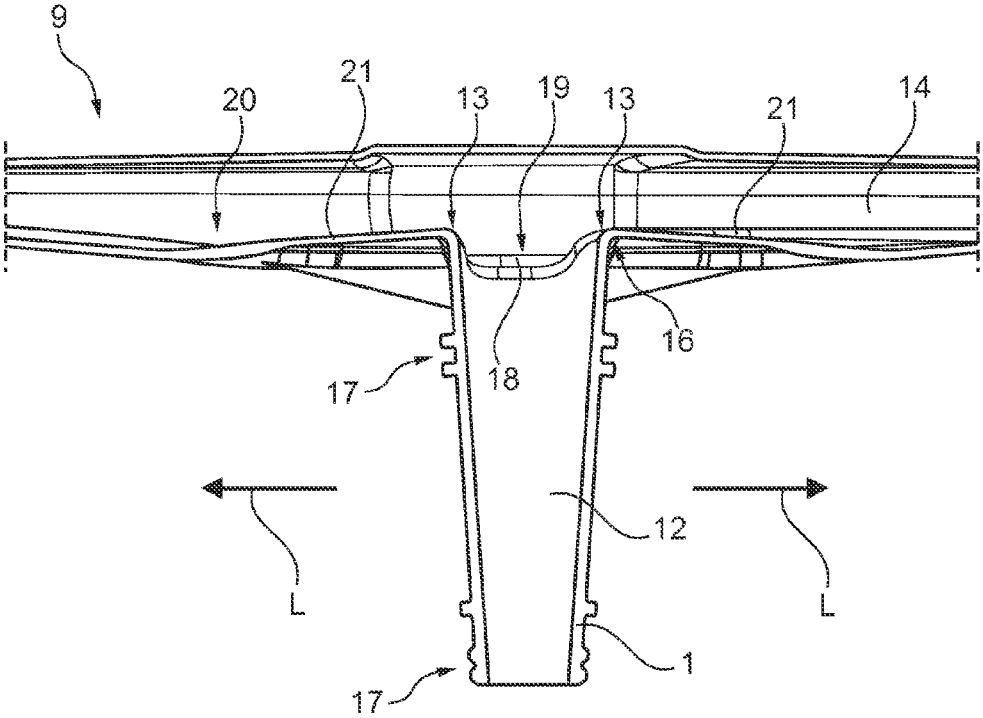
FIG. 5 shows a longitudinal section along the line V-V in FIG. 2.

As clearly shown in the sectional views in FIG. 5 onward, the cross section of the supply tube 12 flares continuously to its terminal end 13 and forms a Venturi tube. During operation a free jet (static pressure equal to zero) directed perpendicularly upward into the Venturi tube 12 below the spray arm is generated by a nozzle. It then bridges the transition to the rotating part with minimal leakage losses. This jet with purely dynamic pressure must then be converted back to water with static pressure with the smallest possible pressure losses by way of the widening of the diameter. The extension of the Venturi tube 12 serves this purpose. This gives the water flowing through more time and travel distance.

As shown in FIG. 5 for example, a section through a side wall 15 of the supply tube 12 forms a profile that flares from the narrowest point to the terminal end 13, with the radius of curvature 16 decreasing in proximity to the terminal end 13. It therefore transitions in a rounded manner into an inner wall region 20 of the spray arm 9.

In the illustrated exemplary embodiment of the lower spray arm 9 the supply tube 12 passes from below into said spray arm 9, which is supported here by way of two support points 17 disposed at a vertical distance from one another.

The supply tube 12 here ends with its upper end within the cavity 14 of the spray arm 9. As the point projecting furthest into the spray arm 9—in the arrangement shown therefore the highest point—the terminal end 13 can run all the way round the Venturi tube 12 or can have individual peripheral segments 13*a*, 13*b* with one or more breaks 18 in between.

The single-part or multipart terminal end 13 here projects beyond a lowest point 19 of the bottom wall region 20 of the spray arm 9 by at least three millimeters, in some instances in particular even by at least ten millimeters, preferably between three and twenty millimeters.

The lowest point 19 is located in the cavity 14 of the spray arm 9 below the plane of the terminal end 13 and serves to receive water or wash liquor S held in the cavity 14 of the spray arm 9. The water or wash liquor S can flow back from the lowest point 19 to empty the spray arm 9. The lowest point 19 here is located adjacent to the terminal end 13; for example the lowest point 19 runs in a ring round the terminal end 13.

Figure 8:
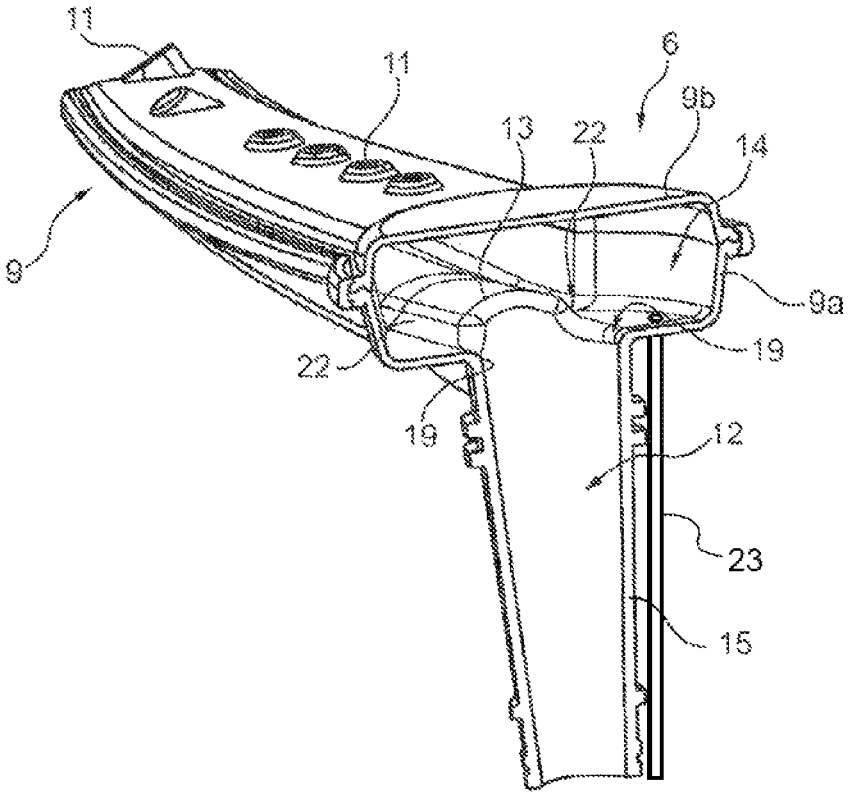
FIG. 8 shows a perspective continued cross-sectional view roughly along the line VI-VI in FIG. 2 according to another exemplary embodiment.

At least one bypass line 23, which is schematically illustrated in FIG. 8, passing downward from the lowest region 19 is provided here so that the water or wash liquor S can flow back, said bypass line having an adequate diameter so that particles of solid matter from the items being washed that may be present in the spray arm do not block it.

In contrast in the illustrated exemplary embodiment the terminal end 13 is broken by regions 18 which are lower than it, which at the same time form the lowest point and serve as a drain for the water or wash liquor S held in the cavity 14 of the spray arm 9 directly into the opening of the Venturi tube 12, so that the water or wash liquor S can flow back.

Figure 6:
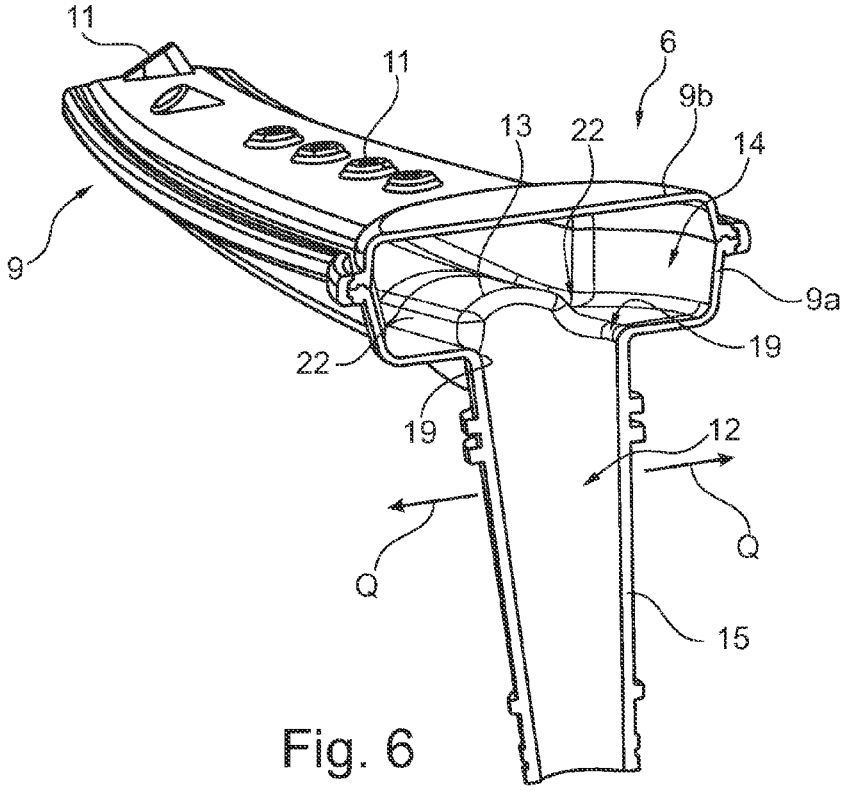
FIG. 6 shows a perspective continued cross-sectional view roughly along the line VI-VI in FIG. 2.
Figure 7:
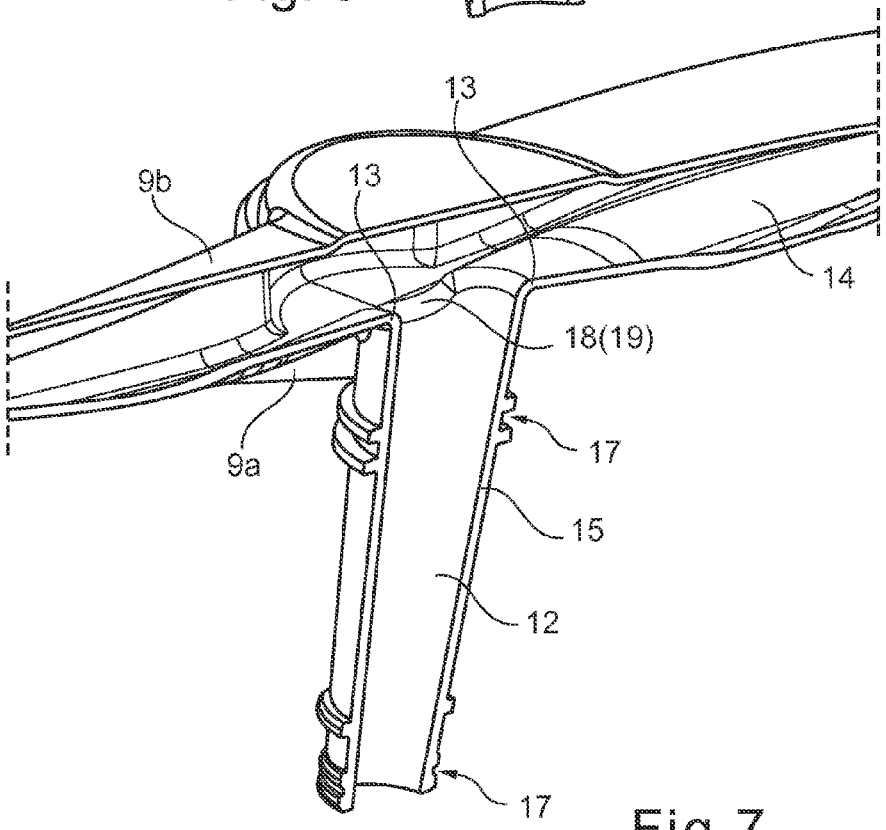
FIG. 7 shows a similar, partially sectional and partially perspective view, but viewed longitudinally through the Venturi tube and the spray arm.

According to the drawing the terminal end 13 forms two opposing upper edge segments 13*a*, 13*b* of the supply tube 12. As shown in FIGS. 5 and 6 for example, these each transition into web regions 21, which are higher than the lowest regions and extend in the longitudinal direction L of the spray arm 9.

Their start in the center of the spray arm 9 can be on a level with the segments 13*a*, 13*b* of the terminal end 13. The web regions 21 each have a raised cross-sectional surface configuration that drops at both transverse sides Q, so that water can run easily from the web regions in the transverse direction.

Two lower drain channels 22 that open into the at least one lowest point 19 are also configured along the longitudinal direction L of the spray arm 9 on both sides of the web regions in each wing of the spray arm 9. They can receive the residual water draining from the webs 21 and combine it to form a water flow, which is directed quickly and efficiently back by way of the lowest point 19. This prevents resoiling due to liquor displacement, thereby improving the wash result. It also avoids a dead volume in which water would collect. The lack of dead volume means that less water FW has to be supplied to the dishwasher 1 to achieve true running of the pump. This saves water in each wash cycle. In practice the spray arm 9 can drain back into the supply tube 12 by way of the drain channels 22 and the lowest point 19.

Figure 3:
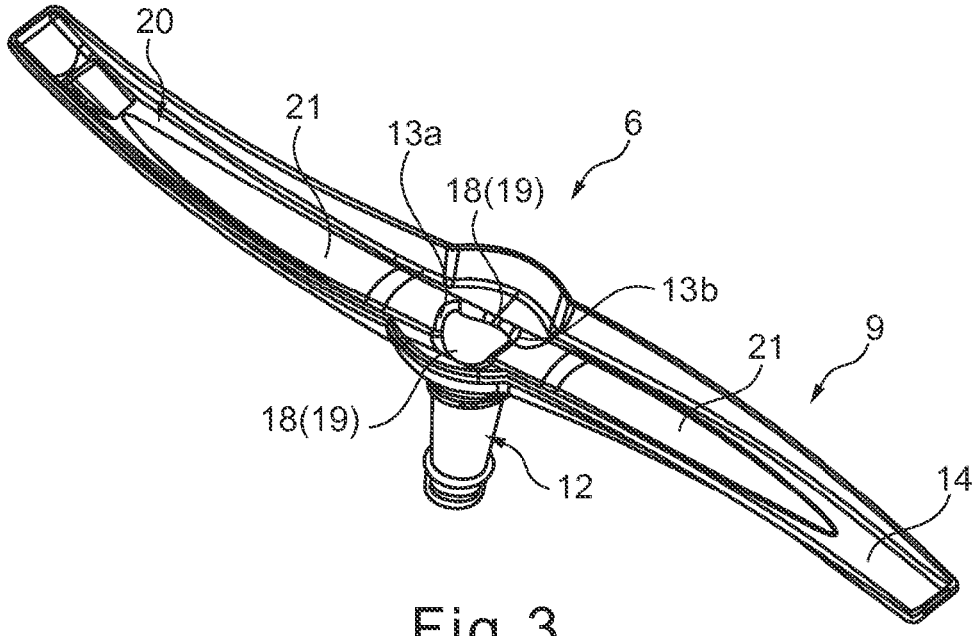
FIG. 3 shows a spray arm according to FIG. 2 from the same perspective as there, but before the fitting of an upper shell, looking into the inner wall of a lower shell that is then visible from above.
Figure 4:
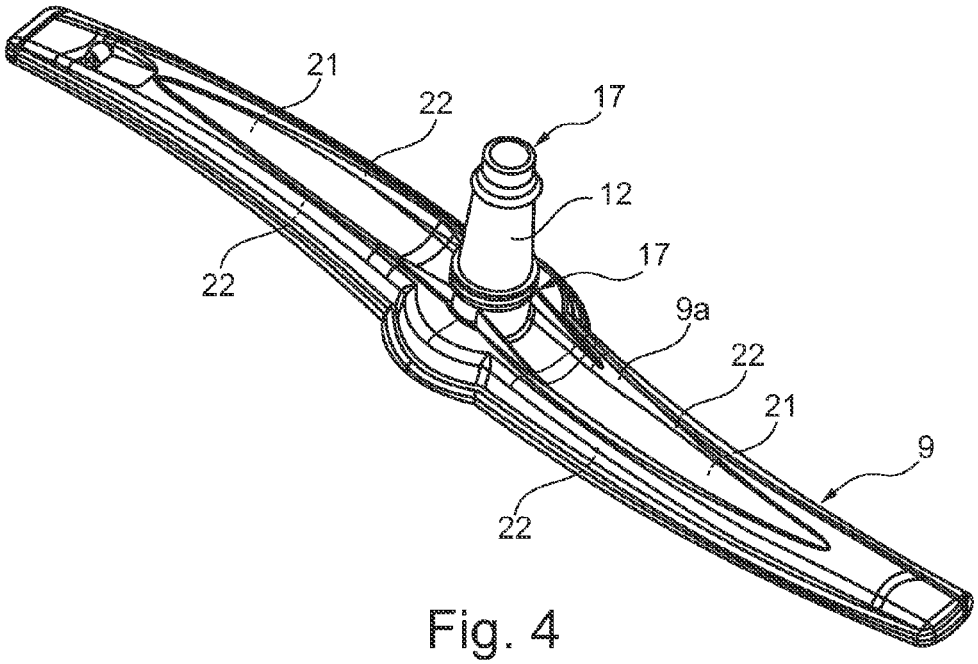
FIG. 4 shows the spray arm according to FIG. 2 viewed obliquely from below.

As shown in FIG. 3, a lower shell 9*a* of the spray arm 9 can be configured as a single piece with the web regions 21, the drain channels 22 and the supply tube 12, in particular as a molded plastic part. Like the upper shell 9*b* it can be produced using an injection molding process. One possible plastic is in particular polypropylene, optionally with mineral reinforcement to improve stability and resistance to chemical reactions.

With the present arrangement the height requirement is in any case small in relation to the pressure generated in the spray arm 9, 10. A large amount of space therefore remains for items to be washed, as the position of the lower edge for the dishes in the lower rack 4 is determined from the sum of the height of the circulating pump, the Venturi tube 12 and the spray arm 9.

The extended Venturi tube 12 also allows greater efficiency to be achieved when converting the speed to pressure of the supplied water or wash liquor.

The invention claimed is:

1. A dishwasher, comprising:

a dishwashing compartment;

a rack provided in the dishwashing compartment for holding items to be cleaned;

a rotatable spray arm associated with the rack for applying water or wash liquor liquid upon the items, said spray arm having a cavity, and an upright supply tube for supplying water or wash liquor liquid to the spray arm, said supply tube having a side wall, said supply tube having a peripheral terminal end which faces the spray arm and is configured to project into the cavity and thereby is extended into the spray arm, wherein at least one region of the side wall of the supply tube flares continuously to the peripheral terminal end of the supply tube which extends into the spray arm, thereby increasing an active length of the supply tube.

2. The dishwasher of claim 1, wherein the dishwasher is a domestic dishwasher.

3. The dishwasher of claim 1, wherein the supply tube has a cross section which flares continuously to the terminal end, said supply tube forming a Venturi tube.

4. The dishwasher of claim 1, wherein the side wall of the supply tube has a profile that flares from a narrowest point to the terminal end and wherein the side wall has in proximity to the terminal end a decreasing radius of curvature.

5. The dishwasher of claim 1, wherein the terminal end transitions in a rounded manner into an inner wall region of the spray arm.

6. The dishwasher of claim 1, wherein the supply tube enters the spray arm from below, wherein the terminal end of the at least one region of the side wall of the supply tube projects beyond a lowest point of an inner wall region of the spray arm by at least five millimeters.

7. The dishwasher of claim 6, wherein the terminal end of the at least one region of the side wall of the supply tube projects beyond the lowest point of the inner wall region of the spray arm by at least ten millimeters.

8. The dishwasher of claim 1, wherein the terminal end of the at least one region of the side wall of the supply tube projects beyond the lowest point of the inner wall region of the spray arm between three and twenty millimeters.

9. The dishwasher of claim 1, wherein the terminal end of the supply tube forms a segment of the supply tube that projects furthest into the spray arm and is sized to extend over at least a subregion of a periphery of the supply tube.

10. The dishwasher of claim 1, wherein the spray arm has a lowest region in the cavity below a plane of the terminal end of the at least one region of the side wall of the supply tube to enable water or wash liquor liquid held in the cavity of the spray arm to flow back to empty the spray arm.

11. The dishwasher of claim 10, further comprising at least one bypass line passing downward from the lowest region to enable water or wash liquor liquid to flow back from the spray arm.

12. The dishwasher of claim 10, wherein at least another region of the terminal end is lower than the at least one region of the side wall to provide a drain for water or wash liquor liquid held in the cavity of the spray arm into the supply tube to enable water or wash liquor liquid to flow back into the supply tube from the spray arm.

13. The dishwasher of claim 10, wherein the terminal end forms two opposing upper edge segments of the supply tube, each said edge segments transitioning into a web region that is positioned at a higher plane than the lowest region and extends in a longitudinal direction of the spray arm.

14. The dishwasher of claim 13, wherein the web regions of the edge segments each have a raised cross-sectional surface configuration that drops at both sides.

15. The dishwasher of claim 13, further comprising lower drain channels which open into the lowest region and are configured on both sides of the web regions of the edge segments.

16. The dishwasher of claim 1, wherein the spray arm has a lower shell which is configured as a single piece with the supply tube.

17. The dishwasher of claim 16, wherein the lower shell of the spray arm is configured as a molded plastic part.

18. The dishwasher of claim 1, wherein the side wall of the supply tube includes a second region that extends to a lower plane than a plane of the at least one region of the side wall.

19. The dishwasher of claim 18, wherein the at least one region of the side wall of the supply tube extends above a lowest point of the inner wall of the cavity, and wherein the second region of the side wall of the supply tube does not extend above the lowest point of the inner wall of the cavity.

20. The dishwasher of claim 19, wherein the at least one region of the side wall faces in a direction of the spray arm, and wherein the second region of the side wall of the supply tube faces in a direction that is perpendicular to the direction of the spray arm.

21. A dishwasher, comprising:

a dishwashing compartment;

a rack provided in the dishwashing compartment for holding items to be cleaned;

a rotatable spray arm associated with the rack for applying water or wash liquor liquid upon the items, the spray arm having an inner wall defining a cavity, and a supply tube coupled to the spray arm for supplying water or wash liquor liquid to the cavity of the spray arm, wherein the supply tube includes a terminal end that projects into the cavity of the spray arm, and wherein at least a first region of the side wall of the supply tube extends beyond a lowest point of the inner wall of the cavity and flares continuously to the peripheral terminal end of the supply tube which extends into the spray arm, thereby increasing an active length of the supply tube without increasing a length of the supply tube that is external to the spray arm.

22. The dishwasher of claim 21, wherein the side wall includes a second region that extends to the lowest point of the inner wall of the cavity.

23. The dishwasher of claim 22, wherein the second region flares continuously to the lowest point of the inner wall of the cavity.

24. The dishwasher of claim 22, wherein the first region of the side wall faces in a direction of the spray arm, and wherein the second region of the side wall faces in a direction that is perpendicular to the direction of the spray arm.

* * * * *